United States Patent [19]

Rogalski et al.

[11] Patent Number: 4,735,436

[45] Date of Patent: Apr. 5, 1988

[54] SKI ATTACHMENT

[76] Inventors: Rudolph S. Rogalski; Steven R. Rogalski, both of 2346 E. Silvia St., Phoenix, Ariz. 85022; Curtis J. Rogalski, 815 W. Beardsley Rd., Phoenix, Ariz. 85027

[21] Appl. No.: 53,872

[22] Filed: May 26, 1987

[51] Int. Cl.[4] ..... A63C 11/00

[52] U.S. Cl. ..... 280/809; 441/71

[58] Field of Search ..... 280/604, 609, 809, 816, 280/12 H; 441/71

[56] References Cited

U.S. PATENT DOCUMENTS 3,025,539 3/1962 Kincaid ..... 441/71

3,052,899 9/1962 Antoine ..... 441/71

3,229,312 1/1966 Smith ..... 441/71

3,255,472 6/1966 Thorne ..... 441/71

*Primary Examiner*—John J. Love

*Assistant Examiner*—Michael Mar

*Attorney, Agent, or Firm*—Herbert E. Haynes, Jr.

[57] ABSTRACT

An attachment for mounting on the rear edge of a snow ski includes a mounting portion for securing the attachment to the ski, an extension portion extending rearwardly and downwardly from the mounting portion, a carrier portion extending rearwardly and upwardly from the exterior portion, and a blade element depending downwardly from the carrier portion. During use, the blade element penetrates a snowy surface to create a snow jet or "rooster tail" effect.

20 Claims, 1 Drawing Sheet

SKI ATTACHMENT

BACKGROUND OF THE INVENTION

1. Field of the Invention

This invention relates to accessories for snow skis and, more particularly, to an attachment for mounting on the rear edge of a snow ski for the purpose of creating a snow jet or "rooster tail" and for improving ski control.

2. Description of the Prior Art

Professional water skiers performing in exhibitions before the public are often able to produce a spectacular "rooster tail" or jet of water which sprays out behind their skis, adding an extra degree of showmanship and visual excitement to their performance. The "rooster tail" effect is created by means of a small hole which is drilled in the back of each ski. As the skis glide over the surface of the water, a small stream of water is forced upwardly through the hole to form a fountain or plume which resembles the tail of a rooster; hence, the name "rooster tail".

Snow skiers skiing in extremely loose, powdery snow are sometimes able to generate a spray of snow from the backs and sides of their skis which also looks quite showy and exciting. However, the spray is not concentrated in a single plume in the manner of a "rooster tail", and thus does not create as dramatic an effect as a water skier is able to create. Furthermore, because the spray can only be generated in powdery snow, skiers skiing on tightly packed or icy snow are not able to inject this small bit of extra showmanship into their performances. Some snow skiers have attempted to duplicate the "rooster tail" effect created by water skiers by drilling a similar hole in the back of their skis, but this hole immediately becomes clogged with packed snow and ice and ceases to function as desired.

Therefore, a long-felt demand has existed for a ski attachment which can be mounted on the rear edge of a ski for the purpose of creating a "rooster tail".

SUMMARY OF THE INVENTION

In accordance with the present invention, a new and improved attachment for mounting on the rear edge of a snow ski is presented. Two such attachments are provided per pair of skis, with one attachment being adapted for mounting on the right ski and the other attachment being adapted for mounting on the left ski.

The ski attachment comprises a mounting portion for securing the attachment to the rear edge of a ski, a slanted extension portion which extends rearwardly and downwardly from the mounting portion toward the ground, a slanted carrier portion which extends rearwardly and upwardly from the extension portion, and a blade element which depends from the carrier portion to penetrate the snow. The primary function of the attachment per se and the blade elements in particular is to dig into the snow, directing a stream of powder upwardly along the surface of the blade to create a jet or "rooster tail". However, it has also been found that the blade increases a skier's control by dampening ski oscillations, and by acting as a stable pivot point for the downhill ski when the skier wishes to turn. The decrease in a skier's speed due to friction, drag and the like from the blade element has proved to be negligible.

In a first embodiment of the invention, the mounting portion of the attachment comprises a flat metal plate adapted to be secured by means of bolts, rivets, screws, or the like to the top surface of the ski proximate the rear edge thereof. The extension portion, which is substantially planar and includes a straight outer edge and a curvilinear inner edge, defines an angle of approximately 200° with respect to the top surface of the mounting plate, with which it is integrally formed. The carrier portion comprises a planar segment which extends upwardly and rearwardly from the rearmost edge of the extension portion, defining an angle of approximately 120° therewith. The outer edge of the carrier portion is continuous with the straight outer edge of the extension portion and curves inwardly therefrom, terminating slightly inwardly of the longitudinal axis of symmetry of the ski on which the attachment is mounted. The inner edge of the carrier portion is continuous with the curvilinear inner edge of the extension portion and also curves inwardly, terminating just below the end of the outer edge. The blade element, which is substantially V-shaped in configuration, extends downwardly from the end points of the inner and outer edges of the carrier portion and terminates below the bottom surface of the ski.

In a second embodiment of the invention, the mounting portion of the attachment comprises a flat plate which is secured to the bottom surface of the ski by means of a pair of channel members formed at opposite edges of the plate. Each channel member receives a different one of the opposite longitudinal edges of the ski, and is secured thereto by means of bolts, rivets, screws or the like which extend from the top flange of the channel through the top surface of the ski. The extension portion extends downwardly and rearwardly from the flat bottom plate of the mounting portion, and terminates a short distance behind the rear edge of the ski. The carrier portion, which extends upwardly and rearwardly from the extension portion, is substantially V-shaped in cross-section and defines a vertex which is colinear with the longitudinal axis of symmetry of the ski. The blade element depends from the central area of the carrier portion, and extends through a cut-out section between the extension and carrier portions to a terminal point below the bottom surface of the ski.

In either embodiment of the invention, the attachment is preferably manufactured from a single sheet of corrosionresistant material such as untempered stainless steel which has been annealed to improve its ductility before being mechanically worked to its final state. The material selected should be of high enough strength to enable it to withstand relatively large deflective forces of the type experienced by a skier traveling over rought, snowy terrain, and yet should be of low resilience so as to reduce the amount of ski oscillations under the aforementioned conditions.

Accordingly, it is an object of this invention to provide a blade ski attachment for mounting on the rear edge of a snow ski in order to create a "rooster tail" effect and to improve a skier's control.

Another object of the invention is to provide a nonresilient ski attachment for dampening ski oscillations in poor ski conditions.

Still another object of the invention is to provide a ski attachment with a blade element configured to dig into the snow behind a skier without significantly decreasing the skier's speed.

The foregoing and other objects of the present invention, as well as the invention itself, may be more fully understood from the following description when read in conjunction with the accompanying drawings.

DESCRIPTION OF THE PREFERRED EMBODIMENTS

Figure 1:
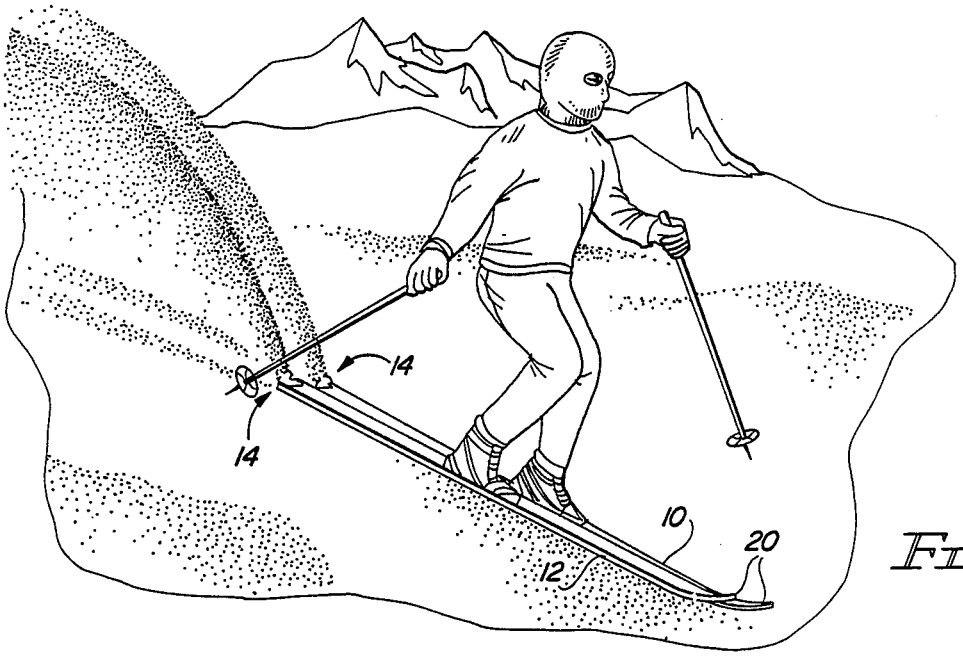
FIG. 1 is a perspective view showing a skier using a pair of skis provided with the attachment of the present invention.

Referring more particularly to the drawings, FIG. 1 shows a skier using skis 10, 12 each of which has been equipped with an attachment 14 according to the present invention. As is well known, each ski comprises an elongated, narrow strip of fiberglass, wood, metal or laminated material having an outer longitudinal edge 16, an inner longitudinal edge 18, a tapered front edge 20, and a straight rear edge 22. Each ski 10, 12 is symmetrical about a central longitudinal axis X—X.

Figure 2:
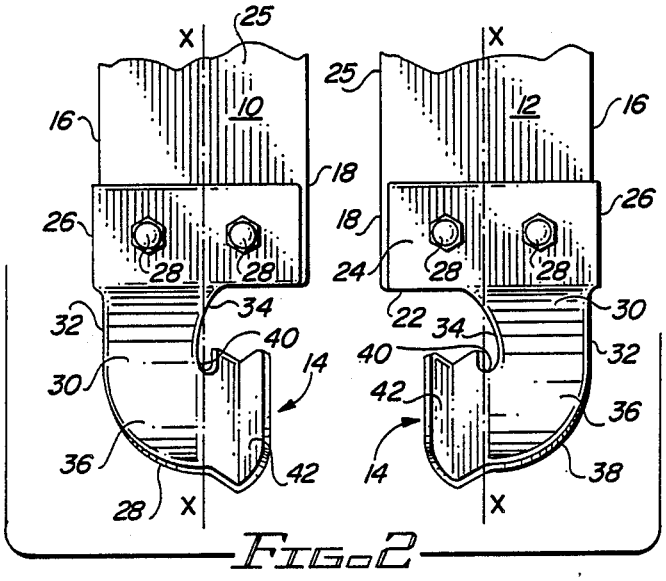
FIG. 2 is a top view showing a pair of ski attachments according to a first embodiment of the invention.
Figure 4:
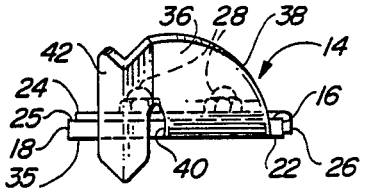
FIG. 4 is a back view of the ski attachment of FIG. 3.
Figure 3:
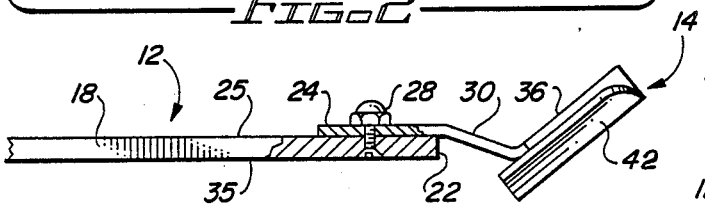
FIG. 3 is an inner side view of one of the ski attachments of FIG. 2.

In the first embodiment of the invention, shown in FIGS. 2–4, each attachment 14 includes a mounting portion for attachment to the rear surface of one of the skis 10, 12. The mounting portion comprises a flat metal plate 24 which overlies the top surface 25 of the ski, and a depending flange 26 which extends along the outer longitudinal edge 16 of the ski to ensure proper positioning of the attachment 14. The mounting portion may be secured to the ski by any suitable fastener means 28 such as bolts, rivets, screws or the like which pass through the plate 24 and the ski.

A substantially planar extension portion 30 extends rearwardly and downwardly from the mounting plate 24, defining an angle of approximately 200° therewith. The extension portion 30, which is integrally formed with the mounting portion, includes a straight outer edge 32 and a curvilinear inner edge 34, each of which terminates at a level which may be even with or slightly below the bottom surface 35 of the ski.

A carrier portion 36 is formed integrally with the extension portion 30, extending rearwardly and upwardly therefrom and defining an angle of approximately 120° therewith. The outer edge 38 of the carrier portion 36 is continuous with the straight outer edge 32 of the extension portion 30 and curves inwardly therefrom, terminating slightly inwardly of the longitudinal axis X—X of the ski. The inner edge 40 of the carrier portion 36 is continuous with the curvilinear inner edge 34 of the extension portion 30 and also curves inwardly, terminating just below the end of the outer edge 38.

A blade element 42, which is substantially V-shaped in configuration, extends downwardly from the end points of the outer and inner edges 38, 40 of the carrier portion 36 and terminates below the bottom surface of the ski. For best results, the blade element 42 should extend to a depth of approximately ¼-inch below the bottom surface of the ski, since a blade extending deeper into the snow will produce too much drag and noticeably slow a skier down, while a shallower blade depth will not produce an adequate "rooster tail effect".

Figure 5:
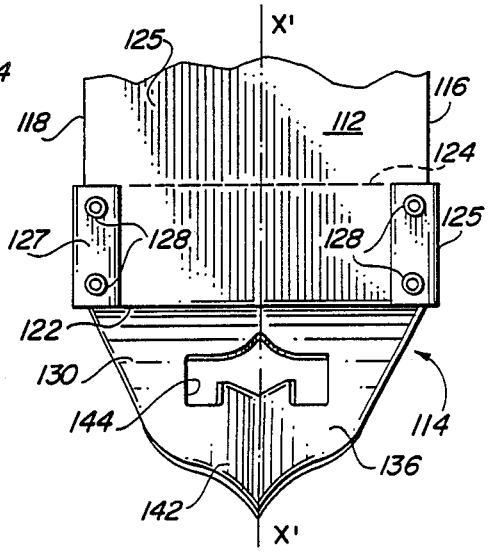
FIG. 5 is a top view showing a ski attachment according to a second embodiment of the invention.
Figure 6:
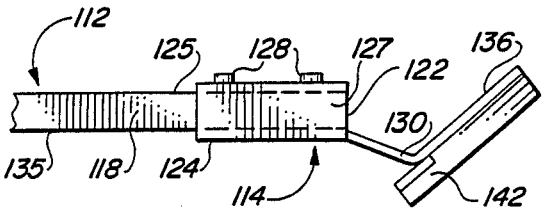
FIG. 6 is a side view of the ski attachment of FIG. 5.

In a second embodiment of the invention, shown in FIGS. 5 and 6, the attachment 114 is symmetrical about the longitudinal axis X′—X′ of symmetry of the ski 112. The mounting portion of the attachment 114 comprises a flat plate 124 which is secured to the bottom surface 135 of the ski 112 by emans of a pair of channel members 125, 127 formed at opposite edges of the plate 124. Each channel member 125, 127 receives a different one of the opposite longitudinal edges 116, 118 of the ski 112, and is secured thereto by means of fasteners 128 such as bolts, rivets, screws or the like which extend through the top flange of the channel into frictional engagement with the top surface 125 of the ski.

The extension portion 130 of the attachment 114 extends downwardly and rearwardly from the flat bottom plate 124 of the mounting portion, and terminates a short distance below and behind the rear edge 122 of the ski.

The carrier portion 136, which extends upwardly and rearwardly from the extension portion, is substantially V-shaped in cross-section and defines a vertex which is colinear with the axis of symmetry X′—X′. The blade element 142 depends from the central area of the carrier portion 136 and extends through a cut-out section 144 between the extension and carrier portions 130, 136 to a terminal point below the bottom surface 135 of the ski.

In both embodiments of the invention, the attachment is preferably manufactured from a single sheet of corrosion-resistant material such as untempered stainless steel which has been annealed to improve its ductility before being mechanically worked to its final state. The material should be of high enough strength to enable it to withstand relatively large deflective forces of the type experienced by a skier traveling over rough, snowy terrain, and yet should be of low resilience so as to reduce the amount of ski oscillation under the aforementioned conditions.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What we claim is:

1. An attachment for mounting on the rear edge of a snow ski, said attachment comprising:

(a) a mounting portion for securing said attachment to the rear edge of a ski;

(b) an extension portion which extends rearwardly and downwardly from said mounting portion and having a lower end;

(c) a carrier portion which extends rearwardly and upwardly from the lower end of said extension portion; and (d) an open blade substantially coextensive with said carrier portion and having upwardly extending sidewalls and a lower end which is disposed below the lower end of said extension portion for penetrating into a snowy surface and creating a jet of snow.

2. The attachment of claim 1, in which said attachment is formed from untempered stainless steel.

3. The attachment of claim 1, in which said mounting portion comprises:
(a) a flat plate for placement on the top surface of a ski;
(b) a depending flange portion for extending along a longitudinal edge of a ski to ensure proper positioning of said attachment; and
(c) fastener means extending through said flat plate for securing said plate to the top surface of the ski.

4. The attachment of claim 1, in which said mounting portion comprises:
(a) a flat plate for attachment to the bottom surface of a ski;
(b) a pair of channel members, each channel member being formed at an opposite edge of said flat plate for receiving a different longitudinal edge of a ski; and
(c) fastener means extending through said channel members for securing said channel members to the ski.

5. The attachment of claim 1, in which said attachment is symmetrical about a longitudinal axis.

6. A ski assembly comprising, in combination:
(a) a pair of snow skis, each ski being symmetrical about a longitudinal axis and including an outer longitudinal edge, an inner longitudinal edge, a tapered front edge and a straight rear edge; and
(b) a pair of ski attachments, each attachment being secured proximate the rear edge of a different one of said skis, and including:
I. a mounting portion for securing said attachment to the rear edge of one of said skis;
II. an extension portion which extends rearwardly and downwardly from said mounting portion and having a lower end;
III. a carrier portion which extends rearwardly and upwardly from said extension portion the lower end of; and
IV. an open blade substantially coextensive with said carrier portion and having upwardly extending sidewalls and a lower end which is disposed below the lower end of said extension portion for penetrating into a snowy surface and creating a jet of snow.

7. The ski assembly of claim 6, in which said attachment is formed from untempered stainless steel.

8. The ski assembly of claim 6, in which said blade element is substantially V-shaped in cross-section.

9. The ski assembly of claim 6, in which said mounting portion comprises:
(a) a flat plate secured to the top surface of one of said skis; and
(b) a flange portion depending from said flat plate and extending along said outer longitudinal edge of said ski.

10. The ski assembly of claim 6, in which said blade element on each of said attachments is located inwardly of said longitudinal axis of symmetry of the ski on which said attachment is mounted.

11. The ski assembly of claim 6, in which said blade element on each of said attachments extends approximately 1/4inch below the surface of the ski on which said attachment is mounted.

12. The ski assembly of claim 6, in which the mounting element of each attachment comprises:
(a) a flat plate underlying the bottom surface of one of said skis;
(b) a pair of channel members, each channel member being formed at an opposite edge of said flat plate and receiving a different longitudinal edge of said ski; and
(c) fastener means extending through said channel members for securing said channel members to said ski.

13. The ski assembly of claim 6, in which each of said attachments is symmetrical about the longitudinal axis of the ski on which said attachment is mounted.

14. The ski assembly of claim 6, in which said blade element depends from a central area of said carrier portion and extends through a cut-out portion formed between said carrier portion and said mounting portion.

15. An attachment for mounting on the rear edge of a snow ski which is symmetrical about a longitudinal axis, said attachment comprising:
(a) a mounting portion for securing and attachment to the rear edge of a ski, said mounting portion including;
I. a flat plate for overlying the top surface of the ski;
II. a depending flange portion for extending along a longitudinal edge of the ski to ensure proper positioning of said attachment; and
III. fastener means extending through said flat plate for securing said plate to the top surface of said ski;
(b) a substantially planar extension portion integral with said mounting portion and extending rearwardly and downwardly therefrom, said extension portion including a straight outer edge a curvilinear inner edge and a lower end;
(c) a substantially planar carrier portion integral with said extension portion and extending rearwardly and upwardly from the lower end of said extension portion, said carrier portion including an outer edge continuous with said straight outer edge of said extension portion and curving inwardly therefrom, and an inner edge continuous with said curvilinear inner edge of said extension portion and curving inwardly therefrom, each of said edges having an end point located inwardly of the longitudinal axis of symmetry of the ski when said attachment is secured thereto; and
(d) an open blade having upwardly extending sidewalls, said blade extending laterally from said endpoints of said outer and inner edges of said carrier portion and having a lower end which is disposed below the lower end of said extension portion for penetrating a snowy surface and creating a jet of snow.

16. The attachment of claim 15, in which said blade element is substantially V-shaped in cross-section.

17. The attachment of claim 15, in which said extension portion defines an angle of approximately 200° with respect to said flat plate of said mounting portion.

18. The attachment of claim 15, in which said carrier portion defines an angle of approximately 120° with respect to said extension portion.

19. The attachment of claim 15, in which said attachment is formed from untempered stainless steel.

20. The attachment of claim 15, in which said blade element extends approximately ¼-inch below the bottom surface of said ski when said attachment is mounted on said ski.

* * * * *